US006693850B2

(12) United States Patent
Mulaw

(10) Patent No.: US 6,693,850 B2
(45) Date of Patent: Feb. 17, 2004

(54) CIGARETTE CASE WITH LIGHTER AND CLOCK

(76) Inventor: Azanaw Mulaw, 1901 Thistlewood Dr., Fort Washington, MD (US) 20744

( * ) Notice: Subject to any disclaimer, the term of this patent is extended or adjusted under 35 U.S.C. 154(b) by 141 days.

(21) Appl. No.: 09/968,791

(22) Filed: Oct. 3, 2001

(65) Prior Publication Data

US 2003/0063523 A1 Apr. 3, 2003

(51) Int. Cl.[7] ..... A24F 15/10; B65D 85/00; G04B 47/00; G04B 37/00

(52) U.S. Cl. ..... 368/10; 368/276; 206/242; 206/86

(58) Field of Search ..... 368/10, 276; 206/249, 206/89, 242, 85–86; 221/2, 3, 15; 131/270

(56) References Cited

U.S. PATENT DOCUMENTS

| | | | | | |
|---|---|---|---|---|---|
| 3,608,704 | A | | 9/1971 | Kopp | |
| 3,722,742 | A | * | 3/1973 | Wertz | 221/15 |
| 3,999,412 | A | | 12/1976 | Boroski et al. | |
| 4,190,148 | A | * | 2/1980 | Schade, II et al. | 206/89 |
| 4,303,154 | A | * | 12/1981 | Hicks | 206/86 |
| 4,311,448 | A | | 1/1982 | Strauss | |
| 4,620,555 | A | * | 11/1986 | Schwarz | 131/270 |
| 4,850,481 | A | * | 7/1989 | Chern | 206/249 |
| 4,852,729 | A | | 8/1989 | Conte | |
| 4,862,431 | A | * | 8/1989 | Drouin | 368/10 |
| 5,205,402 | A | * | 4/1993 | Maeda | 206/250 |
| 5,630,503 | A | | 5/1997 | Rhodes et al. | |
| 5,711,423 | A | | 1/1998 | Fuller, Jr. | |
| 5,746,587 | A | | 5/1998 | Racine et al. | |
| 6,119,852 | A | | 9/2000 | Focke et al. | |
| 6,125,082 | A | | 9/2000 | Reid | |
| D439,370 | S | * | 3/2001 | Chen | D27/161 |

* cited by examiner

*Primary Examiner*—David Martin
*Assistant Examiner*—Jeanne-Marguerite Goodwin
(74) *Attorney, Agent, or Firm*—Siemens Patent Services, LC

(57) ABSTRACT

There is provided a cigarette case having a compartment for the storage of cigarettes and a second compartment of for the storage of a removable lighter or, alternatively, a lighter as an integral element of the case. An access door allows the removal of a cigarette from the case and the use of the lighter, while a separate installation door allows a pack of cigarettes to introduced into the cigarette compartment. An integral clock allows a user to set an alarm to sound at either a desired time or after a desired period of time, a feature beneficial to one desiring to limit the frequency of smoking. An adjustable spacer plate within the cigarette compartment accommodates either "regular" or "king" cigarettes. A clip on the back of the case allows for clipping the case to a user's belt, a automobile's sun visor or other similar object.

17 Claims, 2 Drawing Sheets

CIGARETTE CASE WITH LIGHTER AND CLOCK

BACKGROUND OF THE INVENTION

1. Field of the Invention

The present invention relates to cases for the carrying of cigarettes. More particularly, the invention comprises an adjustable, hard bodied cigarette case having the additional feature of an integral cigarette lighter and digital clock, the clock being useful for timing the interval between cigarettes smoked.

2. Description of the Prior Art

As long as smokers have carried pre-rolled cigarettes, whether roll-your-own or commercial, they have faced the problem of bending, crushing and breaking them in their pockets or purses. Through the years, cigarette cases have been developed which have overcome most of these problems, as well as the problem of keeping matches or a lighter handy, by incorporating lighter storage into the case.

U.S. Pat. No. 3,608,704, issued to Yvette Boasso Kopp on Sep. 28, 1971, presents a COMBINED CIGARETTE LIGHTER CASING AND SLIDABLE CLOSURE in which a cigarette lighter is proportioned to approximately match the dimensions of the end of a cigarette pack. A clip on the lighter is adapted to slide under the flaps forming the end of a soft pack and the tax stamp such that the lighter form a slidable cover over an opened portion of the pack end. KOPP provides no protection to the cigarettes within the pack other than a closure over the opened portion of the pack end. The present invention, however provides a full, hard case to protect the pack from crushing or bending.

U.S. Pat. No. 3,999,412, issued to Ahenrietta M. Boroski on Dec. 28, 1976, presents a CIGARETTE DISPENSER, a hard cigarette case designed to hold a single tier of cigarettes which have been placed in the case individually. A spring at the base of the case forces the cigarettes upwardly as the case is opened, dispensing one cigarette at a time, prohibiting access to additional cigarettes in the case. The lid of the case has a timer activated latch. Unlike BOROSKI's requirement for filling the case with individual cigarettes, the present invention is designed to receive a pack of cigarettes, as an entirety and does not limit the removal of cigarettes from the case.

U.S. Pat. No. 4,311,448, issued to Edward Strauss on Jan. 19, 1982, presents a SMOKING ELIMINATION GUIDANCE SYSTEM, a cigarette lighter having a timer controlled mechanism which limits the frequency of ignition of the lighter. By contrast, the lighter of the present invention is an adjunct to a cigarette case and is in no way limited as to the frequency of ignitions.

U.S. Pat. No. 4,852,729, issued to John R. Conte on Aug. 1, 1989, presents a CIGARETTE-LIGHTER HOLDER, a two compartment, open ended sleeve designed to receive a pack of cigarettes in a first compartment and a lighter in a second compartment. While CONTE provides protection to a substantial portion of a pack of cigarettes, at least one end of the pack is exposed. The present invention, on the other hand, fully encloses a pack of cigarettes protecting them fully from spillage, crushing or bending.

U.S. Pat. No. 5,630,503, issued to Kenneth Rhodes, et al., on May 20, 1997, presents a COMBINATION CIGARETTE PACK AND LIGHTER HOLDER. A two compartment lower case, quite similar to CONTE, is designed to receive a pack of cigarettes in a first compartment and a lighter in a second compartment. Unlike CONTE; RHODES, et al., provide an upper case which slides down over the lower case to fully enclose the cigarettes and lighter. RHODES, et al., the two elements of the case must be fully separated in order to remove a cigarette from the case, while in the present invention only an access cover need be opened in order to remove a cigarette or the lighter.

U.S. Pat. No. 5,711,423, issued to Arthur G. Fuller, Jr., on Jan. 27, 1998, presents a PACKAGE CONTAINER WITH WASTE DISPOSAL COMPARTMENT which could be configured as a cigarette case. A movable inner partition divides an outer container such that as the contents of a package within the container is depleted the package may be reduced in size and waste materials may be stored in the remainder of the container. Unlike the present invention, however, FULLER makes no provision for a lighter or other adjunct features presented by the present invention.

U.S. Pat. No. 5,746,587, issued to Roland Racine, et al., on May 5, 1998, presents a LIGHTER ATTACHABLE TO A CIGARETTE PACKET, a preferably disposable lighter having a flip top cigarette case incorporated into its body. While RACINE provides a both lighter and full protection to the cigarettes contained within the associated case, no time piece is provided, as in the present invention.

U.S. Pat. No. 6,119,852, issued to Heinz Focke, et al., on Sep. 19, 2000, presents a HINGE-LID BOX FOR CIGARETTES AND THE BLANK FOR PRODUCING THE SAME, which details a flip top, cardboard cigarette case having a sleeve and a bottom flap for constraining a lighter thereto. Being of a light weight material, FOCKE provides only minimal protection to the cigarettes contained therein or attachment of the lighter thereto. Conversely, being of substantial construction, the present invention is designed to provide a greater degree of protection to the cigarettes and lighter contained therein.

U.S. Pat. No. 6,125,082, issued to Adonis M. Reid on Sep. 26, 2000, presents a TIMED CIGARETTE DISPENSER which limits access to cigarettes within the dispenser to predetermined, timed intervals. An electronic timing circuit is connected to a solenoid and a plunger which partially ejects a cigarette at the expiration of the predetermined time period. A latch solenoid prevents the opening of the dispenser unless the storage compartment is empty. An LCD display and key board allows the user to enter and display messages and/or set different time intervals on the timer. The present invention provides accommodations for a lighter within the case, which is lacking in REID.

None of the above inventions and patents, taken either singly or in combination, is seen to describe the instant invention as claimed.

SUMMARY OF THE INVENTION

Maintaining cigarettes in a usable condition has been a problem for smokers from the early days of pre-rolled cigarettes. Likewise, finding a lighter when ready to light a cigarette is often a frustrating and time consuming process. The present invention provides a rigid cigarette case with a lighter incorporated therein. Additionally, for those who are trying to limit the number of cigarettes they smoke, a readily available timepiece, possibly with an alarm is provided.

Accordingly, it is a principal object of the invention to provide a cigarette case which has sufficient rigidity to protect the cigarettes therein from bending, crushing or breaking.

It is another object of the invention to provide a cigarette case further housing a cigarette lighter therein.

It is a further object of the invention to provide a cigarette case having a timepiece contained therein.

Still another object of the invention is to provide a cigarette case having a timepiece which is further capable of providing an alarm at pre-set times or after pre-set time intervals.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
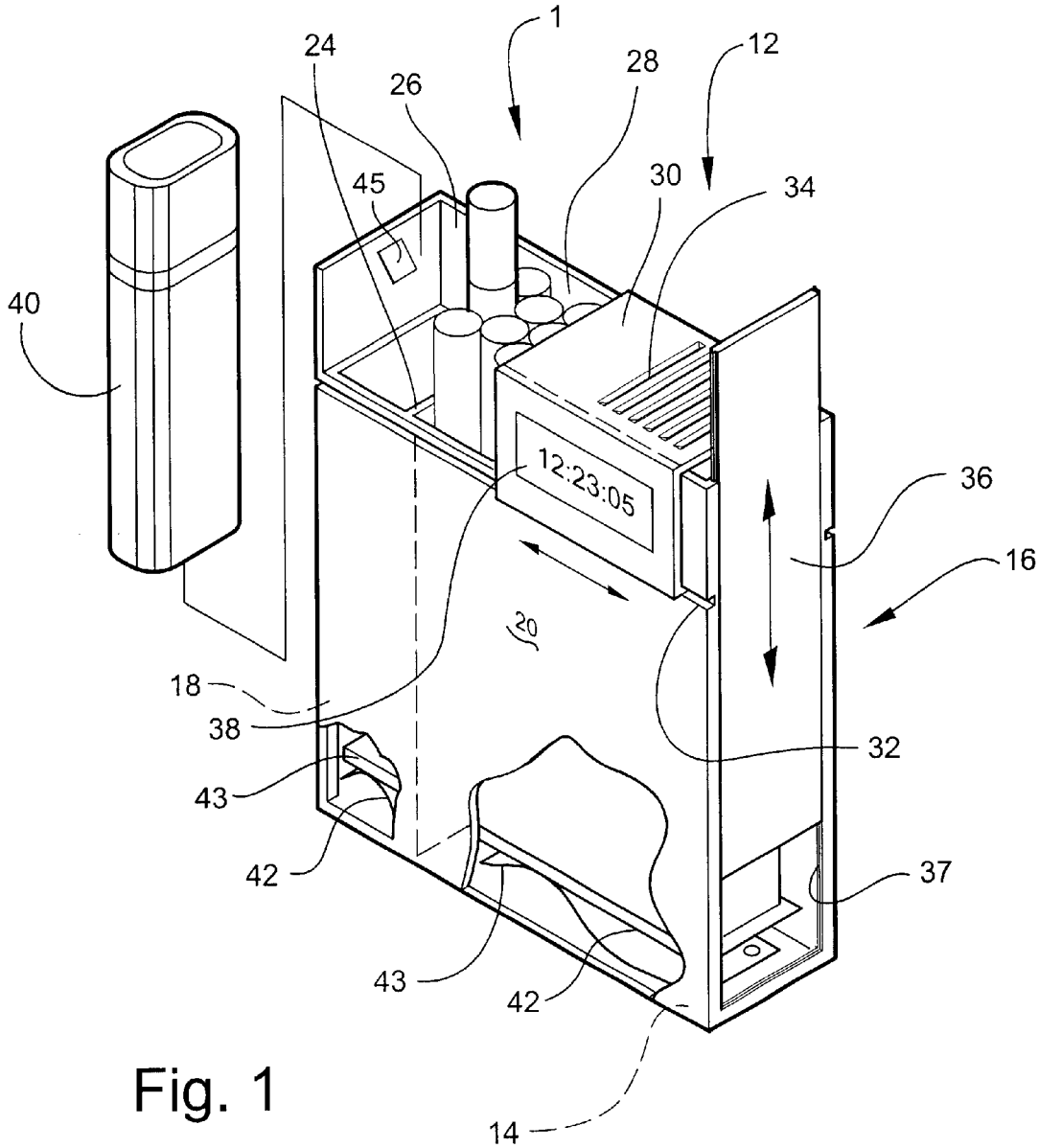
FIG. 1 is a front perspective view of the invention, partially cut away to show internal detail.
Figure 2:
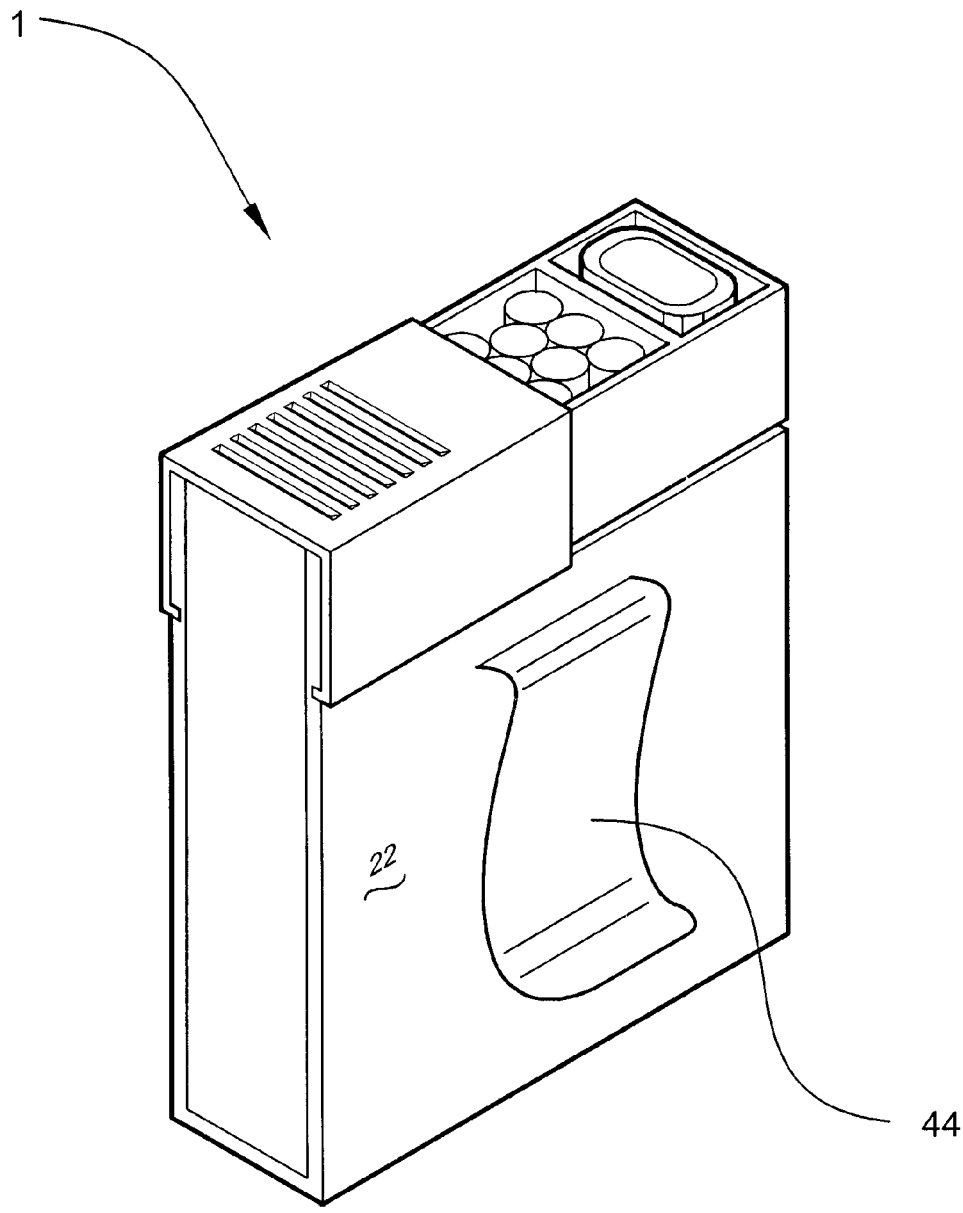
FIG. 2 is a rear perspective view of the invention.

The case 1, as shown in FIGS. 1 & 2, has a hollow body generally configured as a parallelepiped having a top 12, a bottom 14, right and left sides 16, 18, respectively, a front 20 and a back 22. The interior of case 1 is divided into two compartments by an interior wall 24, rigidly affixed between the interior surfaces of bottom 14, front 20 and back 22 and substantially normal to each surface. Bottom 14, left side 18, front 20 and back 22 are substantially solid in their entirety. Approximately one half the length of top 12 is solid, the solid portion being bounded by right side 16, and one half of front 20 and back 22. The left portion of top 12 is open. Interior wall 24 divides the interior of case 1 such that the open portion of top 12 is divided by interior wall 24, forming a lighter chamber 26 and a cigarette chamber 28. The opening in top 12 is overlaid with an access door 30 which, as would be evident to one skilled in the art, could slide in a grooved track 32 formed in front 20 and back 22, or hinged (not shown), either at its juncture with the top edge of left side 18, the top edge of front 20 or back 22, or the solid portion of top 12 and capable of moving between an open position as shown in FIG. 2 and a closed position as shown in FIG. 1. It would be further evident to one skilled in the art that access door 30 could be designed to slide external to case 1 or internal to case 1 with equal effectiveness. A portion of front 20 and the upper portion of inner wall 24 situated behind the front portion of access door 30 could be omitted, as in FIG. 1, for ease of access to the cigarettes and lighter within case 1. An access door release button 34 releases a catch (not shown) which normally hold access door 30 in a closed position, thereby allowing access door 30 to open. It would be evident to one skilled in the art that release button 34 could be located either on access door 30 or a point on case 1 proximate access door 30 or that door 30 could be designed to be manually operated with the release button deleted. Situated within right side 16 is an insertion door 36 which may be opened to install a full pack of cigarettes within cigarette chamber 28, the top of the pack of cigarettes having been removed. Insertion door 36 would preferably slide within a grooved track 37 formed in the inner surfaces of front 20 and back 22, although it would be evident to one skilled in the art that insertion door could be hinged (not shown) or have a different sliding configuration relative to a track.

A clock 38 may optionally be mounted as an element of case 1. In a preferred embodiment, clock 38 would be a digital, liquid crystal display (LCD) clock having an alarm which could be set for a specified time of day or a specified period of time, although it would be evident to one skilled in the art that an analog clock could be used with equal effectiveness. Digital, LCD clocks are well known in the art, therefore, the functioning of the clock will not be further discussed, herein. A user desiring to limit their smoking may easily use the alarm of clock 36 as a control device.

Lighter chamber 26 may optionally hold a removable, replaceable lighter 40, as are known in the art and readily available in the retail market; or an integral, refillable lighter (not shown). Lighters are well known in the art, therefore the details of an integral lighter will not be further discussed herein, other than to mention that, as would be evident to one skilled in the art, an igniter (not shown) and a refill port (not shown) would, of necessity, be a part of case 1. The interior of lighter chamber 26 may optionally have an interior surface (not shown), such as a ribbed or rubberized material, capable of restraining a removable lighter 40 such that it will not readily fall from lighter chamber 26.

In order to make case 1 adaptable to both "regular" and "king" cigarettes, a spacer plate 42 may optionally be included in cigarette chamber 28. The height of spacer plate 42 may be adjusted by a pair of hinges (not shown) or a spring 43 adapted to raise spacer plate 42 above bottom 14. A removable spacer plate 42 may optionally be used. It would be evident to one skilled in the art that case 1 could be produced in different embodiments dimensioned specifically for "king" or "regular" cigarettes, as well as the adjustable embodiment herein described.

A spacer plate 42 and spring 43 similar to those in the cigarette chamber may be installed in lighter chamber 26 to keep lighter 40 elevated to a height where it may be used while in case 1. It would be evident to one skilled in the art that other height adjustment such as, but not limited to, a jack screw type adjuster (not shown) could be used with equal effectiveness. With the installation of a spacer plate 42, a lighter retention clip 45 proximate the top one of the walls of lighter chamber 26 would retain lighter 40 against the upward pressure of spacer plate 42, with lighter 40 being releasable by a slight downward and lateral pressure.

Optional clip 44 is attached to back 24 to facilitate the carrying of case 1 on an individual's belt, an automobile's sun visor or other, similar, object.

Case 1 could be produced from a variety of different materials, including, but not limited to a metal, a plastic, or wood.

It is to be understood that the present invention is not limited to the embodiments described above, but encompasses any and all embodiments within the scope of the following claims.

What is claimed is:

1. A case for cigarettes comprising:

a top, a bottom, a right and a left side, a front and a back, said top, said bottom, said right and left side, said front and said back enclosing a hollow interior, a first section and a second section formed within said hollow interior, said first section being separated from said second section by an internal partition fixedly attached to at least one of said front, said back and said bottom of said case and substantially normal to each of said front, said back and said bottom of said case, an access door disposed in said top, said access door allowing access to said first section and said second section when in an open state and to seal said first section and said second section when in a closed state, and an insertion door disposed in one of said left side and said right side, said insertion door allowing access to said first section when in an open state and to seal said first section when in a closed state, a spacer plate disposed within said first section, said spacer plate being variably adjustable to change the distance between said top and said spacer plate to accommodate various length of cigarettes.

2. A case for cigarettes, as defined in claim 1, wherein said first section is sized contain cigarettes and said second section is sized contain a lighter.

3. A case for cigarettes, as defined in claim 2, wherein said access door and said insertion door are each attached to said case by one of the means: slidably within a track and hingedly and snap on.

4. A case for cigarettes, as defined in claim 3, further comprising a release button operatively connected to a latch mechanism for retaining said access door in a closed position until released by said release button.

5. A case for cigarettes, as defined in claim 2, wherein said case is formed from at least one of the materials from the group: a polymer, metal and wood.

6. A case for cigarettes, as defined in claim 2, wherein said lighter is one of the group: a self contained, removable lighter and a lighter formed as a permanent, integral element of said case.

7. A case for cigarettes, as defined in claim 2, further comprising a clock mounted within one of said top, said front, said back, said left side and said right side of said case.

8. A case for cigarettes, as defined in claim 7, wherein said clock is one of the group: a digital clock and an analog clock.

9. A case for cigarettes, as defined in claim 8, wherein said clock further comprises an alarm, said alarm signaling at least one event from the group: the attainment of a variably setable time and the passing of a variably setable period of time.

10. A case for cigarettes, as defined in claim 2, further comprising a clip affixed to one of said front and said back of said case, said clip adapted for attachment of said case to an object by fastening over an edge of said object.

11. A case for cigarettes, as defined in claim 2, further comprising a spacer plate disposed within said second section, said spacer plate being variably adjustable to change the distance between said top and said spacer plate to accommodate lighters of various lengths.

12. A case for cigarettes, as defined in claim 11, wherein the height of said spacer plate is adjustable by one method of the group: a spring forcing said spacer plate away from said bottom of said case, at least one hinge raising said spacer plate away from said bottom of said case, and a screw adjuster.

13. A case for cigarettes, as defined in claim 11, wherein said second section further comprises a retention clip proximate the top thereof, said retention clip configured to retain said lighter within said second section.

14. A case for cigarettes, as defined in claim 1, wherein the height of said spacer plate is adjustable by one method of the group: a spring forcing said spacer plate away from said bottom of said case, at least one hinge raising said spacer plate away from said bottom of said case, and a removable said spacer plate having a predetermined thickness.

15. A case for cigarettes comprising:

a top, a bottom, a right and a left side, a front and a back, said top, said bottom, said right and left side, said front and said back enclosing a hollow interior, a first section, sized to contain cigarettes, and a second section, sized to contain a lighter, formed within said hollow interior, said first section being separated from said second section by an internal partition fixedly attached to at least one of said front, said back and said bottom of said case and substantially normal to each of said front, said back and said bottom of said case, an access door disposed in said top and slidably attached to said case and allowing access to said first section and said second section when in an open state and to seal said first section and said second section when in a closed state, said access door providing access to said lighter and selected ones of said cigarettes, and an insertion door disposed in one of said left side and said right side, said insertion door allowing access to said first section when in an open state, thereby allowing the insertion a pack of cigarettes and removal of an empty cigarette pack, and to seal said first section when in a closed state, a release button operatively connected to a latch mechanism for retaining said access door in a closed position until released by said release button, a spacer plate disposed within said first section, said spacer plate being variably adjustable to change the distance between said top and said spacer plate to accommodate various length of cigarettes, the height of said spacer plate being adjustable by one method of the group: a spring forcing said spacer plate away from said bottom of said case, at least one hinge raising said spacer plate away from said bottom of said case, and a removable spacer plate having a predetermined thickness, a spacer plate disposed within said second section, said spacer plate being variably adjustable to change the distance between said top and said spacer plate to accommodate lighters of various lengths, the height of said spacer plate being adjustable by one method of the group: a spring forcing said spacer plate away from said bottom of said case and a screw type adjuster, a retention clip proximate the top of said second section, said retention clip configured retain said lighter within said second section, a clock mounted within one of said top, said front, said back, said left side and said right side, said clock further comprising an alarm signaling at least one event from the group: the attainment of a variably setable time and the passing of a variably setable period time, and a clip affixed to said back of said case, said clip adapted for attachment of said case to an object by fastening over an edge of said object.

16. A cigarette case, as defined in claim 15, wherein said lighter is one of the group: a self contained, removable lighter and a lighter formed as a permanent, integral element of said case.

17. A cigarette case, as defined in claim 15, wherein said case is formed from at least one of the materials from the group: a polymer, metal and wood.

* * * * *